United States Patent [19]

Riedl

[11] 4,350,191

[45] Sep. 21, 1982

[54] ARRANGEMENT FOR CUTTING WOOD INTO CHIPS

[75] Inventor: Reinhold Riedl, Gensingen, Fed. Rep. of Germany

[73] Assignee: Hombak Maschinenfabrik GmbH u. Conkg, Bad Kreuznach, Fed. Rep. of Germany

[21] Appl. No.: 56,786

[22] Filed: Jul. 11, 1979

[30] Foreign Application Priority Data

Jul. 6, 1978 [DE] Fed. Rep. of Germany ..... 28297258

[51] Int. Cl.[3] ..... B27C 1/00

[52] U.S. Cl. ..... 144/172; 144/375; 241/92

[58] Field of Search ..... 241/92; 144/162 R, 172, 144/326 A, 326 B, 326 C, 174, 323

[56] References Cited

U.S. PATENT DOCUMENTS 2,898,958 8/1959 Schubert ..... 144/172

*Primary Examiner*—W. D. Bray

*Attorney, Agent, or Firm*—Michael J. Striker

[57] ABSTRACT

An arrangement for removing material from a workpiece, includes a support component for an elongated workpiece, and a tool component rotatable about an axis and having a circumferential cutting face and axial end faces. The tool component is supported at both end faces thereof. At least one of the above-mentioned components is movable relative to the other component in a predetermined path at least one of the path and axis of rotation is inclined relative to the elongation of a supported workpiece so that the workpiece contacts only the cutting face but does not contact the end faces of the tool component.

9 Claims, 3 Drawing Figures

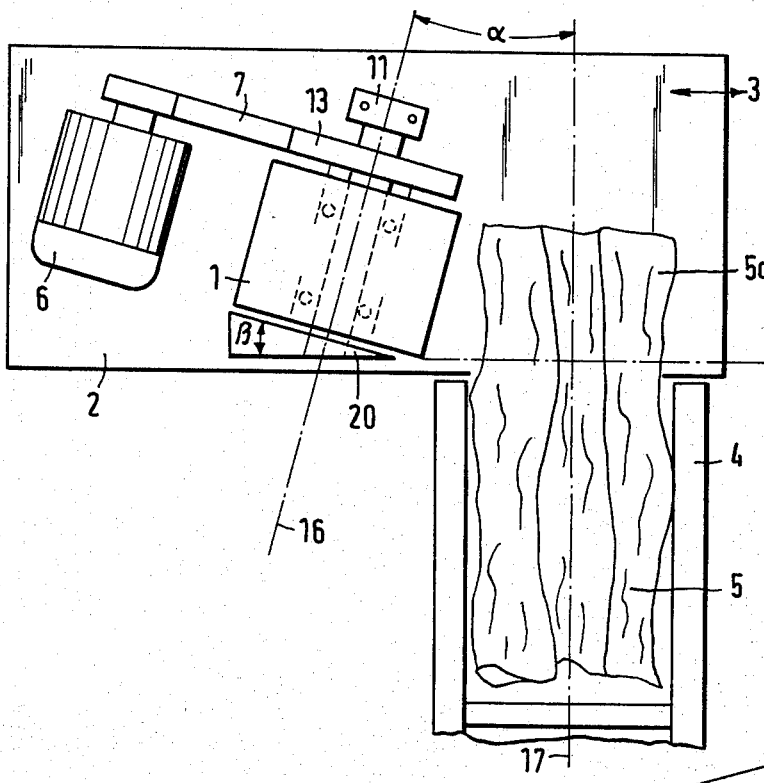
Fig.1
Fig.3
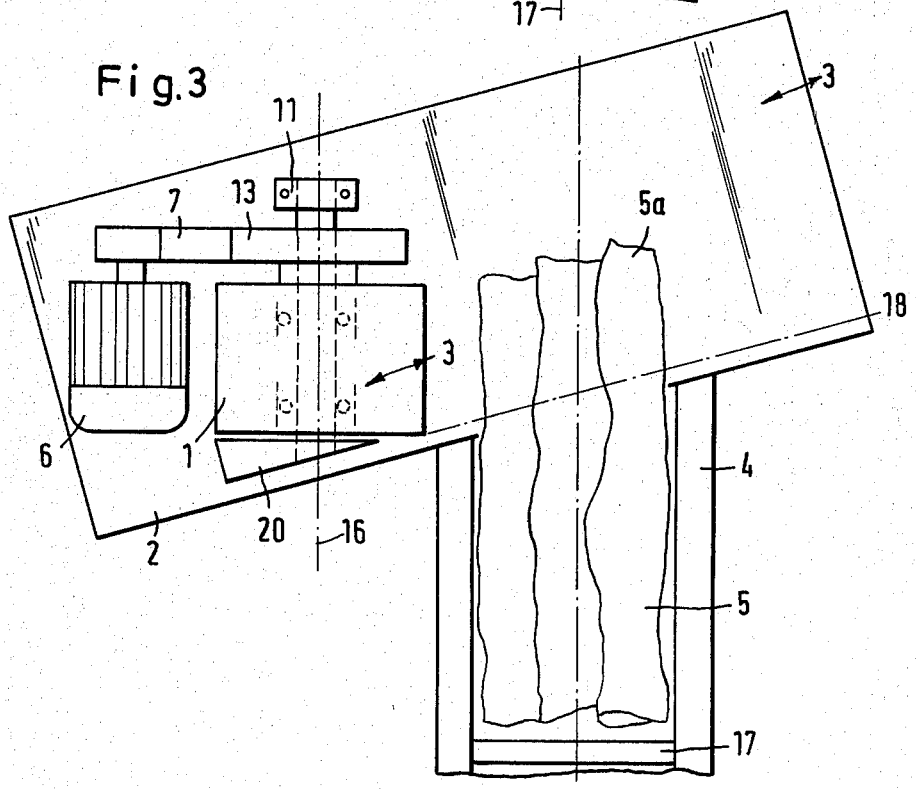

ARRANGEMENT FOR CUTTING WOOD INTO CHIPS

BACKGROUND OF THE INVENTION

The present invention relates to material removing arrangements.

More particularly, the present invention concerns an arrangement for chipping a workpiece of wood.

Such arrangements are well known in the prior art and usually include a support component for an elongated workpiece and a tool component rotatable about an axis and having a circumferential cutting face and axial end faces. At least one of these components, i.e., the support component and/or the tool component, is movable relative to the other component during the working process. The tool component is mounted, at both end faces thereof, for rotation about this axis. The workpiece is displaced intermittently in a direction substantially transverse to the movement of one of the above-mentioned components during the working process. Thus, the workpiece is displaced in this direction so that a portion of the workpiece, to be removed is equal to or smaller than the axial length of the tool. Thereafter the working process starts and the above-mentioned portion of the workpiece may be removed.

Such an arrangement is disclosed, for example, in German Auslegungsschrift No. 1156965. The cylindrical tool is fixedly mounted on a shaft whose bearing supports the tool from both end faces thereof. The bearing element which faces the workpiece to be treated is located in the interior of the tool so that when, during the working process, the tool engages the workpiece, the workpiece passes the bearing support without touching it. However, the advantage of the fact that the tool is mounted at both end faces thereof can be derived only when the height of the workpiece to be cut into chips is much too small as compared with the outer diameter of the tool. Thus, the advantage of supporting the tool from both end faces thereof, which permits to correspondingly increase the axial length of the tool and which in its turn renders it possible to increase the working capacity of such an arrangement by increasing the length of the portion to be removed from the workpiece, is substantially negatively offset by the necessity to keep the height of workpiece to cut into chips significantly small.

Another disadvantage of the known arrangement resides in relatively high and very inconvenient axial loads on the bearing of the shaft supporting the tool. During the working process, the front end face of the workpiece (i.e., the end face which has been already treated) frictionally engages the adjacent end face of the tool and exerts onto the latter axial percussive loads which considerably increase for example during disintegration of the wood structure. These axial loads are transmitted from the tool via the shaft onto the bearing and further onto the other parts of the arrangement. It goes without saying that such loads considerably reduce the service life of the bearing.

Moreover, the frictional engagement between the front end face of the workpiece and the adjacent end face of the tool which rotates with a rather high speed results in considerable vibrations of the workpiece which, obviously, negatively affect the working process.

The above-mentioned disadvantages of the arrangement, where the tool is supported from both end faces thereof, are widely known. There have been attempts to improve the tool having a cantilever support. Usually, these attempts were limited to reducing the inherent shortcomings of the cantilever support of the tool to the most convenient extent. Such as arrangement is disclosed in German utility model DGBM No. 76 19632. The tool is fixedly mounted on a sleeve which is supported by two bearings which are located on a rigid shaft which is rigidly mounted on a support. However, even in this case the useful axial length of the tool has to be kept substantially small since, otherwise, the bending moment exerted onto the tool during the working process can be extremely large. The tool may become deflected as a result of contact with the workpiece, e.g., a piece of wood installed on a carrier, so that, the working (i.e., cutting) relationship and an angle between the tool and the direction of the elongation of the wood fibers may be negatively changed. This fact may lead to substantial reducing of the quality of chipping, for example, especially when the workpiece is a weak long wood piece and as a result of dust accumulation on the tool.

Moreover, the oscillations of the tool mounted on the cantilever may lead to contact between the tool and the counter tool. As a result of such a contact the tool may become suddenly dull, and therefore, it has to be replaced quite often which is, obviously, undesirable for a number of reasons including expenses, time consumption, etc. and, in an extreme situation, more serious damage can be done to the tool itself, or to the counter tool.

SUMMARY OF THE INVENTION

It is a general object of the present invention to avoid the disadvantages of the prior art arrangement for cutting wood into chips.

More particularly, an object of the present invention is to provide an arrangement which permits to considerably increase the sectional dimension of the wood to be cut into chips.

Still another object of the present invention is to provide wood chipping machine which permits to chip wood, having a height which is equal to or only slightly smaller than the outer diameter of the tool mounted at both end faces thereof for rotation about an axis.

In pursuance of these objects and others which will become apparent hereafter one feature of the present invention resides in an arrangement for cutting wood into chips, comprising a support component for an elongated workpiece and a tool component rotatable about an axis and having a circumferential cutting face and axial end faces. Means are provided, at both of said end faces, mounting said tool component for rotation about said axis. Means are further provided, mounting at least one of said components for displacement relative to the other component in a predetermined path. At least one of said path and axis of rotation is inclined relative to the elongation of a supported workpiece so that the workpiece contacts only said cutting face but does not contact said end faces.

In accordance with another feature of the present invention one end face of the tool component, facing the workpiece, includes an acute angle with the elongation of the workpiece. Thus, a wedge-shaped space is developed between said one face of the tool component and a plane extending over a front end face of the workpiece, when a predetermined portion of the latter has been removed. The front end face constitutes a face of the workpiece, directed towards the tool component and is developed by removing the above-mentioned portion of the workpiece.

A bracket is received in said space, which may carry a cover for the above-mentioned one end face of the tool component, which one end face is adjacent to said bracket.

It is possible to displace the support component with the workpiece towards and away from the tool component during the working process. According to a preferred embodiment, however, the support component is stationary and the tool component moves alternately to and from the support component. In this case the tool component includes a sliding carriage.

In the case of the tool component movable towards and away from the stationary support component, the above mentioned wedge-shaped space increases wedge-wise in direction of movement of the tool component away from the support carrying the workpiece. Should the support be movable towards and away from relative to the tool component, the above-mentioned space increases wedge-wise in direction of movement of the support towards the tool component. This wedge-shaped space receives a respective bearing supporting the tool component at said one end face thereof. Thanks to this wedge-shaped space the respective bearing and said one end face of the tool component do not engage the respective front end face of the workpiece during the working process. Such an arrangement renders it possible to remove a portion of the material from the workpiece, having sectional dimension substantially equal or only slightly less than the outer diameter of said cutting face of the tool component. Obviously, the production capacity of the arrangement of the present invention is increased considerably, if compared with the prior art similar arrangements, since it becomes possible to fully use the entire outer diameter of the tool component.

By the same token, it becomes possible to arrange in this wedge-shaped space the cover for the respective one end face of the tool component. Thus, the axial impacts and loads generated by the workpiece during the working process are taken up by the cover and transmitted therefrom on a base adapted for supporting the cover or on a rigid axis and from the latter on the same base to be absorbed there. Advantageously, the means at both said end faces mounting said tool component are not affected by these impacts and loads.

The front end face of the workpiece to be treated does not engage the respective end face of the tool component rotatable with a high speed. On the contrary, the front end face slides during the working process along a respective smooth outer surface of the cover. Such an arrangement renders it possible to reduce the driving energy necessary for rotation and movement of the tool component relative to the workpiece located on said support. Moreover, no vibrations are transmitted from the rotatable tool component onto the workpiece.

Even if the axial length of the tool component is considerable, a rigid and oscillation-free support of the latter is guaranteed. Such a feature makes it possible to construct the arrangement of the present invention with an increased production capacity without having to sacrifice the service life and/or the stability of the construction.

According to a preferred embodiment of the present invention, the wedge-shaped space constitutes an angle of 3° to 5°. Thus, the working direction during the working process, relative to the elongation of the workpiece (i.e., relative to the wood fibers if the workpiece is a piece of wood) remains the same, i.e., the working direction does not change during the working process. The axis carrying the tool component does not deflect during the working process, relative to its initial position arranged before the working process starts. This feature ensures that the cutting relationship is maintained the same throughout the entire working process. Thus, it becomes possible to obtain a comparatively high chipping quality with the arrangement of the present invention.

In still another feature of the present invention the tool component includes a tool itself, a sleeve for rigidly (rotation-free) supporting the tool and which is supported by means of two roller bearings on the axis.

In a further feature of the present invention, means are provided for rotating the tool about the axis. Said means include a motor with a belt transmission operatively connected to said sleeve for rotation of the same and the tool. A brake may be provided with the above-mentioned belt transmission at another end face of said tool, that is the end face directed away from the workpiece to be treated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a schematic view from above of an arrangement in accordance with the present invention;

FIG. 3 is a schematic view of above of another embodiment of the arrangement shown in FIG. 1.

DESCRIPTION OF PREFERRED EMBODIMENTS

Figure 2:
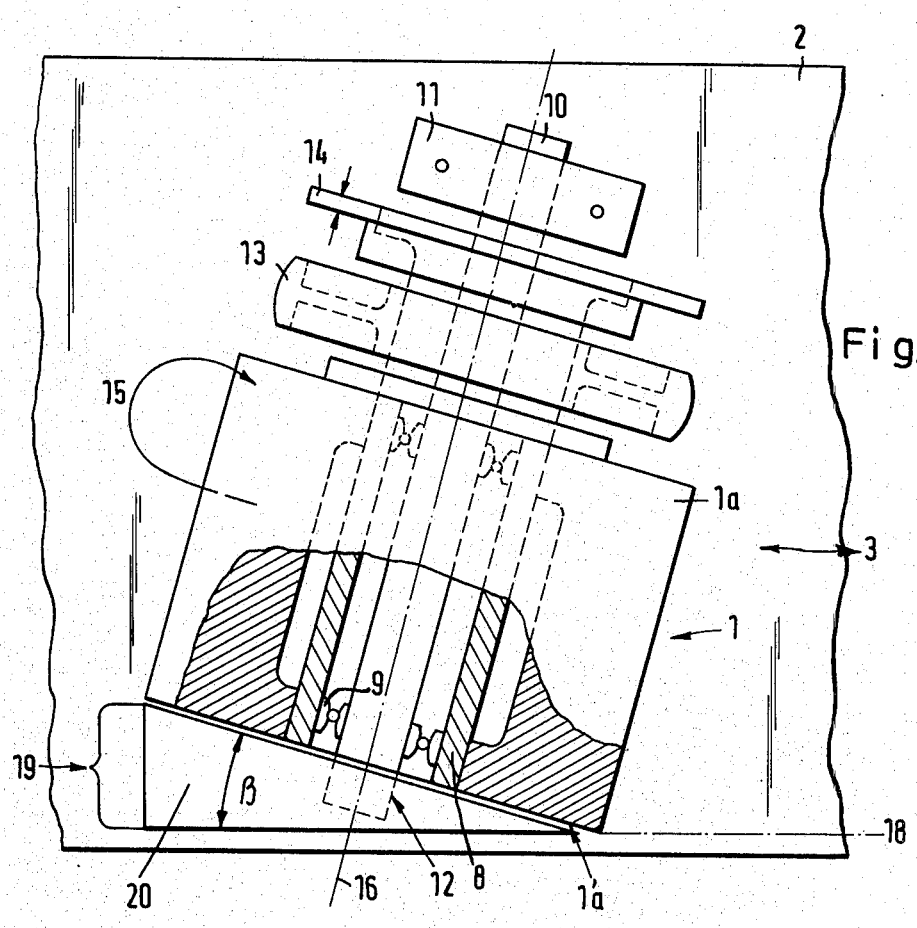
FIG. 2 is an enlarged partially sectioned view of a part of the arrangement shown in FIG. 1.

Referring now to the drawings and first to FIGS. 1 and 3 thereof, it may be seen that the reference numeral 1 is used to designate a tool component in toto which is mounted on a sliding carriage 2 which is movable in direction of a double-headed arrow 3, i.e. towards and away from a stationary support 4 operative for supporting a workpiece 5, which is a piece of wood. It should be understood that the support 4 may be movable in direction of the arrow 3, i.e. towards and away from the carriage. In this case, it is advisable to keep the latter stationary.

The workpiece 5 is movable intermittently relative to the support 4 in direction of an axis 17 so that a portion **5*a* of the workpiece 5 projects in the path of movement of the tool component 1 with the carriage 2. The portion 5*a* is equal to or slightly less than the length of the tool component 1, measured along an axis 16, i.e. the axis of rotation of the tool component 1**.

It should be understood that means for shifting the workpiece 5 along the support 4, for limiting such shifting of the workpiece 5 and fixing the workpiece 5 on the support 4, are well known in the art, and therefore, do not require any detailed discussion or illustration.

The tool component 1 is rotated about the axis 16 by means of a motor 6 mounted on the carriage 2 and a belt transmission 7.

FIG. 2 shows details of the tool component 1. It will be seen that the latter has a tool 1*a* which is fixedly mounted on a sleeve 8 which is supported on an axle 10 by means of two roller bearings 9. The axle 10 is rigidly mounted on the carriage 2 and supports the tool 1*a* from both end faces thereof by means of a clamping holder 11 and a support member 12. The axle 10 is provided at the end face of the tool 1*a*, directed away from the workpiece 5, with a belt pulley 13, which is fixedly mounted on the sleeve 8, and a brake 14. The tool 1*a* rotates in direction indicated by an arrow 15.

FIG. 1 shows that the axis 16 of rotation of the tool 1*a* is inclined relative to the axis 17 of the support 4 at angle $\alpha$. FIG. 3 shows, however, the embodiment in which the axis 16 is parallel to the axis 17. Both arrangements, however, insure that a side face 1'*a* of the tool 1*a* includes an acute angle $\beta$ with a plane 18 which extends over a front end face of the workpiece 5, developed after the portion 5*a* has been removed. The angle $\beta$ is equal to the above-mentioned angle $\alpha$, i.e. 3° to 5°. Thus, a wedge-shaped space is developed between the plane 18 and the end face 1'*a* of the tool 1*a*. The support member 12 extends in this space 19. The bracket 12 carries a cover 20 which covers the respective end face 1'*a* of the tool 1*a*.

Thus, due to the inclination of the axis 16 of the tool component 1 relative to the axis 17 of the support 4 (see FIG. 1) or due to the corresponding inclination of the carriage 2 during its movement in the longitudinal direction indicated by the arrow 3 and relative to the axis 17 of the support 4 (see FIG. 3) there is developed the wedge-shaped space 19 between the end face 1'*a* of the tool component 1 and the plane 18. The support member 12 is received in this space 19, so that during the working process, the support member 12 does not contact the respective front end face of the workpiece 5.

It is possible, instead of moving the tool component and (or the workpiece support 4) in a linear manner (as has been discussed hereabove), to move for example the tool component along a curve with a comparatively big radius so that the cutting relationship is approximately the same as that in the case where the tool component moves along a predetermined linear path.

It will be understood that each of the elements described above, or two or more together, may also find a useful application in other types of an arrangement for removing material from a workpiece.

While the invention has been illustrated and described as embodied in an arrangement for removing material from a workpiece, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for cutting wood into chips comprising an elongated support component for supporting an elongated workpiece with an end portion of said workpiece projecting beyond one end of said support component; a tool component rotatable about an axis and having a circumferential cutting face and axial end faces one of which is directed towards said one end of said support component; means mounting one of said components movable relative to said other component along a predetermined path so that during movement of said components relative to each other said tool component will cut the end portion of the workpiece projecting beyond said one end of said support component into chips while leaving at the remainder of the workpiece a cut end face parallel to said path, at least the one end face of the tool component which is directed towards said one end of said support component includes with a plane including said cut end face a fixed acute angle so that a wedge-shaped space is developed between said one end face of the tool component and the cut end face of the workpiece; bearing means at both end faces of said tool component supporting the latter for rotation about said axis, one of said bearing means being located entirely in said wedge-shaped space, so that said one bearing means will not interfere with the movement of said components relative to each other during cutting of said end portion of said workpiece into chips.

2. An arrangement as defined in claim 1, wherein said elongated support component is stationary and wherein said tool component is movable relative to said stationary support component along a rectilinear path.

3. An arrangement as defined in claim 1, and further comprising means for covering said one end face of the tool component, said covering means being located in said space.

4. An arrangement as defined in claim 3, wherein said covering means include a cover installed on said one support means and adapted to cover said one end face of the tool component.

5. An arrangement as defined in claim 1, wherein said angle is 3° to 5°.

6. An arrangement as defined in claim 1, wherein said tool component includes a tool, a sleeve coaxially fixed to said tool and an axle for supporting said sleeve for rotation about said axle by means of two roller bearings.

7. An arrangement as defined in claim 1, and further comprising means for rotating said tool component about said axis, and including a motor and a belt transmission for operatively connecting said motor to said tool component.

8. An arrangement as defined in claim 7, and further comprising means for braking rotation of said tool component.

9. An arrangement as defined in claim 7, wherein said rotating means are operatively connected to said tool component at one of said side faces thereof, directed away from the support component for the workpiece.

* * * * *